US011279524B2

(12) United States Patent
Spiewok

(10) Patent No.: US 11,279,524 B2
(45) Date of Patent: Mar. 22, 2022

(54) METHOD FOR MANUFACTURING A PACKAGING MATERIAL, A PACKAGING MATERIAL, AND A PACKAGING

(71) Applicant: SILBO SP. Z O.O., Zory (PL)

(72) Inventor: Marcin Spiewok, Zory (PL)

(73) Assignee: SILBO SP. Z O.O., Zory (PL)

( * ) Notice: Subject to any disclaimer, the term of this patent is extended or adjusted under 35 U.S.C. 154(b) by 273 days.

(21) Appl. No.: 16/450,786

(22) Filed: Jun. 24, 2019

(65) Prior Publication Data

US 2020/0002059 A1 Jan. 2, 2020

(30) Foreign Application Priority Data

Jun. 29, 2018 (PL) ..... 426143

(51) Int. Cl.
*B65D 33/01* (2006.01)
*B31B 70/00* (2017.01)
(Continued)

(52) U.S. Cl.
CPC ..... *B65D 33/01* (2013.01); *B31B 70/008* (2017.08); *B31B 70/876* (2017.08); *B65D 33/04* (2013.01); *B65D 33/105* (2013.01)

(58) Field of Classification Search
CPC ..... B65D 33/01; B65D 33/04; B65D 33/105; B31B 2155/0012; B31B 2155/0014;
(Continued)

(56) References Cited

U.S. PATENT DOCUMENTS 5,048,976 A 9/1991 Jung et al.
5,912,197 A * 6/1999 Madderom ..... B65B 9/20 442/305
(Continued)

FOREIGN PATENT DOCUMENTS

DE 202009012135 U1 11/2009
EP 1092635 A1 4/2001
(Continued)

OTHER PUBLICATIONS

Sundqvist European Search Report for Application No. EP 19 18 3378 dated Jan. 29, 2020.

*Primary Examiner* — Andrew M Tecco
*Assistant Examiner* — Nicholas E Igbokwe
(74) *Attorney, Agent, or Firm* — Cherskov Flaynk & Gurda, LLC

(57) ABSTRACT

The invention relates to a production method of a material, a material and packaging intended mainly for food products. The design of the material used in the packaging machines allows for providing handles in the final packaging without the need for secondary operations. The handles are obtained through either placing a secondary narrower web onto the primary material, wherein the handle constitutes said web, or adjacent holes are cut in the primary material, wherein the handle is formed by the holes separating the primary material. A combination of these two methods or materials is also conceivable. In the area of holes, the primary material is joined with the secondary material, which is either a film or a membrane, wherein the secondary material is larger than the holes and it forms an overlap around them. The materials are joined in the overlap area around the inner circumference of the secondary material.

12 Claims, 11 Drawing Sheets

(51) Int. Cl.

| | |
|---|---|
| ***B31B 70/86*** | (2017.01) |
| ***B65D 33/04*** | (2006.01) |
| ***B65D 33/10*** | (2006.01) |

(58) Field of Classification Search

CPC ..... B31B 2155/002; B31B 2160/20; B31B 70/008; B31B 70/864; B31B 70/872; B31B 70/874

See application file for complete search history.

(56) References Cited

U.S. PATENT DOCUMENTS

| | | | | |
|---|---|---|---|---|
| 2009/0202181 | A1 | 8/2009 | Alaux | |
| 2012/0144782 | A1* | 6/2012 | Perick | B65D 75/566 53/452 |
| 2016/0304261 | A1* | 10/2016 | Takano | B65D 75/30 |
| 2017/0361994 | A1* | 12/2017 | Bruns | B65D 29/00 |

FOREIGN PATENT DOCUMENTS

| | | | |
|---|---|---|---|
| EP | 2070831 | A1 | 6/2009 |
| EP | 2441698 | A1 | 4/2012 |
| EP | 2910487 | A1 | 8/2015 |
| EP | 3339004 | A1 | 6/2018 |
| PL | 223961 | | 1/2015 |
| WO | WO03051722 | A2 | 6/2003 |

* cited by examiner

METHOD FOR MANUFACTURING A PACKAGING MATERIAL, A PACKAGING MATERIAL, AND A PACKAGING

PRIORITY CLAIM

The current application claims priority to Polish Patent Application P.426143 filed on Jun. 29, 2018, presently pending, the contents of which are incorporated by reference.

BACKGROUND OF THE INVENTION

Field of the Invention

The invention relates to a method of making a material in the form of a continuous web intended for packaging on vertical form fill seal (VFFS) machines. The invention relates to a material in the form of a continuous web intended for packaging on machines of this type. The invention also relates to a design of a packaging sealed on VFFS machines, formed from material in the form of a continuous web.

The VFFS type machine uses an array of devices for bending, folding, sealing, filling, and cutting from packaging material in the form of a continuous web wound up on a roll. The machine packs products, such as vegetables, fruit into finished packaging comprising said products.

Background

For foodstuffs, transport and storage require ventilation. Therefore, the packaging material is often combined with a membrane that, in addition to providing ventilation, allows the buyer to see and touch the articles inside the packaging. The material from which the packaging is made can also be combined with a film, e.g. in order to display the contents of the packaging. Packaging is performed by a machine, most often at a manufacturers location, in a manner involving the machine that uses a pre-prepared continuous web of film fed from a roll. The roll comprises appropriate printing and joined with webs or openings of the membrane, to seal or glue together a tubular body and then seals or glues together and cuts off individual modules. A module thus obtained is used to package fruit or vegetables.

The finished packaging comprising the commercial product is transported to shops and placed on racks and shelves, from where it is taken by the seller or the end customer. Accordingly, there is a need for the packaging to have a convenient handle. In packages formed on vertical machines of the VFFS type, the handles are usually in the form of cuts or notches at the top seam. In order to ensure adequate strength of such a handle, reinforcements are made at said top seam from the inside, usually made of polyethylene (PE) foil. A more complex packaging method, which also requires to perform more actions, consists in gluing a horizontally oriented handle at the top of the packaging.

The European patent application EP2441698A1 discloses a packaging formed of continuous web, comprising longitudinal continuous webs of PE plastic and longitudinal continuous webs of PP membrane. Individual webs overlap and are joined at the overlap by an additional narrow PE web arranged on the membrane, which, after sealing, connects with the PE plastic web through the holes of the membrane.

According to the Spanish specification ES2204271 (EP2070831), holes are cut in plastic sheets, into which membrane fragments are sealed.

The application P.410324 (published as EP2910487) discloses a continuous web made of plasticised paper for the manufacture of bags for fruit or vegetable products and the like, made of plasticised paper which, in places intended for heat seams, handles and, if provided, at the edges of openings, is equipped with polyethylene reinforcements to increase resistance to mechanical damage. The openings are covered with membrane fragments. A big number of polyethylene reinforcements is detrimental to the looks of the packaging and to the environment. In addition, it produces the problem of the film depositing on the heaters of the sealing machine. This problem is solved by the Polish application P.402682 (also published as P.223961).

The issue of reinforcement of handles in the form of cut-outs or notches is solved by the Polish invention P.419972 (published as EP3339004), where membrane fragments are sealed into the places intended for reinforcement. The membrane can extend throughout the packaging and be sealed in the place of pre-cut out holes of different shapes.

Currently, in view of the need to protect the environment, packaging biodegradability is also a significant problem. In its previous inventions, the Applicant attempted to design biodegradable packaging, replacing PE material with PLA material.

The ZA200004372 (B) (Published as European Patent EP1092635) application discloses a bag composed of a woven tubular membrane with at least one section of a strong, resilient laminate tape, arranged on at least one side of the membrane. The tape is joined to the membrane by two seam lines located close to the vertical edges of the laminar tape sections and two transverse seal lines which delineate the top and the bottom, respectively, of the bag and a third seal line located in the upper portion of the bag and delineating the transverse rectangular area in which the handle or, optionally, round or oval holes for fingers of the user's hand is/are located. The bag is intended for fruit and vegetables, in particular for collection, sale and transport of small quantities of products.

SUMMARY OF THE INVENTION

The aim of the invention is to develop a method for manufacturing packaging material intended to be used with, for example, but not limited to, VFFS machines, which would provide an alternative to fixing of handles in the finished packaging. The aim of the invention is a material that would allow for obtaining a finished packaging with convenient handles, without the need to perform additional operations on packaging machines. The aim of the invention is also the design of a finished packaging, which would have convenient and durable handles constituting an alternative to known packagings.

The essence invention is a method for manufacturing a packaging material, wherein the material is at least one primary web wound on a roll, and wherein holes are cut in the web onto which fragments of the secondary material are arranged. The method is characterised in that at least two holes are cut in the primary material and the fragments of the secondary material with a surface and shape greater than the sum of such adjacent holes and the primary material separating them are arranged onto the hole area so that an overlap is formed around them and the primary material separating them. The materials are then joined in the overlap area only along the inner circumference of the fragment of the secondary material.

Preferably, two holes are cut adjacent and symmetrical to each other in part, at least in relation to a part of their circumference.

Preferably, four holes are cut, with opposite holes being symmetrical to each other.

Preferably, onto at least one web of the primary material wound off a roll, at least one secondary web with a width smaller than the width of the primary web, where the secondary web ultimately constitutes a reinforcement of the handle of the finished packaging. The two webs are joined. At least two adjacent holes are then cut so that the primary material with a secondary web is between them. Fragments of the secondary material with a surface area and shape greater than the sum of such adjacent holes and the primary material and the secondary web separating them are placed onto the area of the holes to form an overlap around them and around the primary and apposed materials separating them. The materials are then joined in the overlap area only along the inner circumference of the fragment of the secondary material.

Preferably, the primary material, the secondary web and the secondary material used are a film or membrane made of sealable polymer or cellulose film, wherein the polymer is PE, PP or PLA.

Preferably, the primary material, the secondary web used are a polymer-coated paper, and the secondary material used is a film or membrane made of sealable polymer or cellulose film, wherein the polymer is PE, PP or PLA.

The essence of the invention is further a packaging material comprising at least one web of the primary material wound on a roll comprising holes with fragments of the secondary material, characterised in that there is a fragment comprising the primary material between at least two holes. The secondary material has a surface and shape greater than the sum of the surfaces and shapes of said holes including the surface of the fragment of the primary material that joins them. The secondary material covers the holes and the fragment of the primary material that joins them to form an overlap. The secondary material is fixed to the primary material around its inner circumference in the overlap area.

Preferably, the primary material comprises at least one secondary web located within at least the fragment of the primary material between the holes that is attached thereto layerwise, wherein the secondary web in the final packaging constitutes the reinforcement of the handle formed between the holes.

Preferably, the primary material and, the secondary web is a polymer-coated paper, and the secondary material is a film or membrane made of sealable polymer or cellulose film, wherein the polymer is PE, PP or PLA.

The essence of the invention is further a packaging made of the primary material, the inside of which is closed by two lateral joints and at least one longitudinal joint. The package comprises one hole filled with the secondary material. The package is characterised in that a fragment of the primary material constituting a handle is placed between at least two holes. From the centre of the packaging, said holes and the fragment of the primary material are covered by the fragment of the primary material, the surface and shape of which are greater than the sum of the surfaces and shapes of the holes and the primary material separating them that forms a circumferential overlap around the openings. The secondary material is fixed to the primary material in the overlap area around its inner circumference.

Preferably, the fragment of the primary material constituting the handle comprises reinforcements in the form of the secondary web joined thereto layerwise. Preferably, the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

The essence of the invention is further a method for manufacturing a packaging material, where the material is at least one primary web wound on a roll. The method is characterised in that onto at least one web of the primary material wound off a roll, at least one secondary web with a width smaller than the width of the primary web, which secondary web ultimately constitutes a handle of the finished packaging, after which both webs are joined in the joint areas of the handles of finished packagings with the primary material.

Preferably, the joint area consists of at least two places in the area intended for one final packaging.

Preferably, holes are cut in the primary material, after which at least one secondary web is placed and fixed to the primary web in the area of the holes, after which fragments of the primary material are placed with an overlap on the areas of the holes and on the fragments of the secondary web with a surface and shape larger than the surface of the individual holes, after which the materials are joined in the area of the overlaps.

Preferably, the primary material, the secondary web used is a film made of a sealable polymer, and the secondary material used is a film or membrane made of a sealable polymer or cellulose film, wherein the polymer is PE, PP or PLA. Preferably, the primary material, the secondary web used are a polymer-coated paper, and the secondary material used is a film or membrane made of sealable polymer or cellulose film, wherein the polymer is PE, PP or PLA.

The essence of the invention is further a packaging material comprising at least one web of the primary material wound on a roll. The material is characterised in that it comprises at least one web of the secondary material of a width smaller than the primary material, constituting the handle of the final packaging, wherein both webs are joined layerwise, locally in a discontinuous manner at least at the points constituting the joint of the handle of the final packaging and of the primary material.

Preferably, the material comprises holes and that the secondary web is arranged in the areas of holes, under the primary material, while under the secondary web there are fragments of the secondary material, which are larger than the holes and which, when placed, form an overlap within which the materials are joined. Preferably, the primary material, the secondary web is a film made of a sealable polymer, and the secondary material is a film or membrane made of sealable polymer or cellulose film, wherein the polymer is PE, PP or PLA.

Preferably, the primary material, the secondary web is a polymer-coated paper, and the secondary material is a film or membrane made of sealable polymer or cellulose film, wherein the polymer is PE, PP or PLA.

The essence of the invention is further a packaging made of the primary material, the inside of which is closed by two lateral joints and at least one longitudinal joint and comprising a handle. The packaging is characterised in that there is the secondary web constituting the handle between the lateral joints, wherein the secondary web is joined to the packaging at least at the lateral joints. Preferably, the packaging comprises at least one hole, closed by a fragment of the secondary material which is larger than the hole and forms an overlap from the middle of the packaging and which is joined with the primary material within the overlap.

Preferably, the secondary web is located in the area of the hole generally above the fragment of the secondary material.

Preferably, the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

The essence of the invention is further a packaging made of the primary material, the inside of which is closed by two lateral joints and at least one longitudinal joint and comprising a handle. The package is characterised in that the handle of the packaging in the form of a web surrounds the packaging and is joined with the primary material at least at the longitudinal joint.

Preferably, the packaging comprises at least one hole, closed by a fragment of the secondary material which is larger than the hole and forms an overlap from the middle of the packaging and which is joined with the primary material within the overlap.

Preferably, the secondary web is located in the area of the hole generally above the fragment of the secondary material.

Preferably, the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

The invention is advantageous because of the method for manufacturing the material, which can be obtained without substantial upgrades to existing production lines, allowing for manufacturing a material in the form of a continuous web comprising handles. The material can be successfully used in existing and functioning packaging machines, without the need to add any special equipment dedicated to the manufacture of handles thereto. The provision of the packaging comprising handles does not require the number of operations during the packaging process to be increased. The packaging according to the invention is advantageous in that it has a convenient handle and a design allowing to ensure that there are appropriate conditions for the goods inside and to display the contents of the packaging.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

Figure 2:
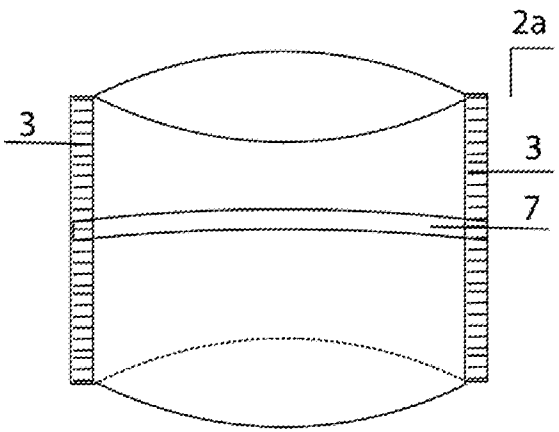
FIG. 2 illustrates the finished packaging made of the material shown in FIGS. 1 and 3.

The foregoing summary, as well as the following detailed description of certain embodiments of the present invention, will be better understood when read in conjunction with the appended drawings.

To the extent that the figures illustrate diagrams of the functional blocks of various embodiments, the functional blocks are not necessarily indicative of the division between hardware circuitry. Thus, for example, one or more of the functional blocks (e.g. processors or memories) may be implemented in a single piece of hardware (e.g. a general purpose signal processor or a block of random access memory, hard disk or the like). Similarly, the programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
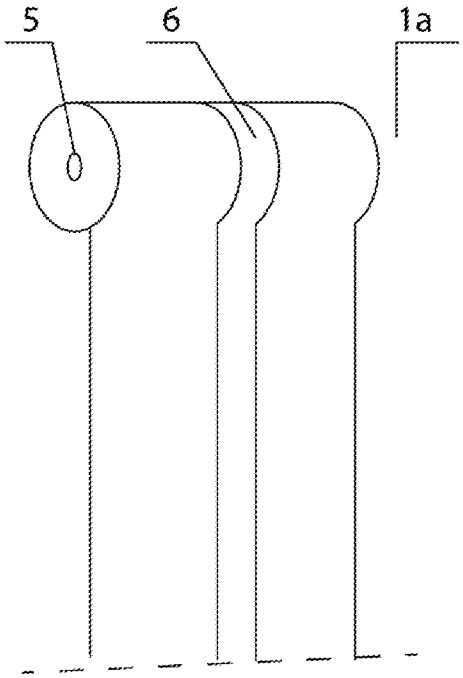
FIG. 1 illustrates a fragment of the material according to the invention comprising a secondary longitudinal web.
Figure 3:
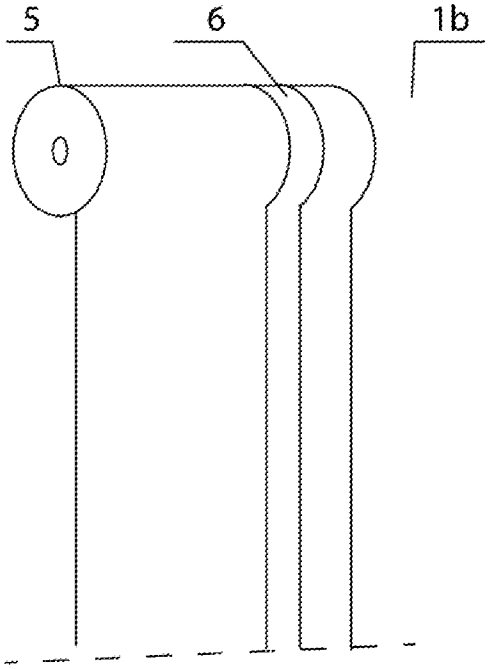
FIG. 3 also illustrates a fragment of the material according to the invention comprising a secondary longitudinal web.

In the embodiment (FIGS. 1, 2, 3, 4), the primary material is one web made of the sealable material 1*a*, that is to say a PLA (polylactide) film wound on a roll 5 (FIG. 1), and the final packaging 2*a*, 2*b* (FIGS. 2 and 4) is a bag with two lateral joints 3 in the form of seals and one longitudinal joint 4 in the form of a seal. The method for manufacturing the packaging material consists in placing onto a web of the primary material 1*a* wound off a roll, longitudinally in the middle (FIG. 1) or on the side (FIG. 3) thereof one secondary web 6 made of a sealable material such as a PLA film with a width of 10 to 50 mm, which is generally smaller than the width of the primary web 1*a*. Ultimately, the secondary web 6 is the handle 7 of the finished packaging 2*a*, 2*b*. The web of the primary material and the secondary web are sealed together over an area smaller than their interface area. In this example, they are sealed together at the points which, in the final packaging, constitute the joint of the handle 7 with the primary material 1*a* and constitute lateral seals 3.

First Example

The packaging material (FIG. 1, FIG. 2) in the example comprises a web of the primary material 1*a*, 1 *b* wound on a roll 5 and it comprises one secondary web 6 with a width of 10 to 50 mm, generally smaller than the primary material 1*a*, 1 *b*. The secondary web 6 extends across the primary material. The secondary web 6 is the handle 7 of the finished packaging 2*a*, 2*b*. Both webs are joined one above the other at the points which constitute the joint of the handle 7 of the final packaging 2*a*, 2*b* and the primary material 1*a*. This point coincides with the point of lateral joints 3 of the final packaging 2*a*, 2*b*. The material is a sealable PLA polymer film, and the secondary web is also a PLA polymer film. The primary material 1*a*, 1 *b* and the secondary web 6 are sealed together. The primary material 1*a* and 1*b* and secondary web 6 may also be paper coated with a sealable PLA polymer.

Figure 4:
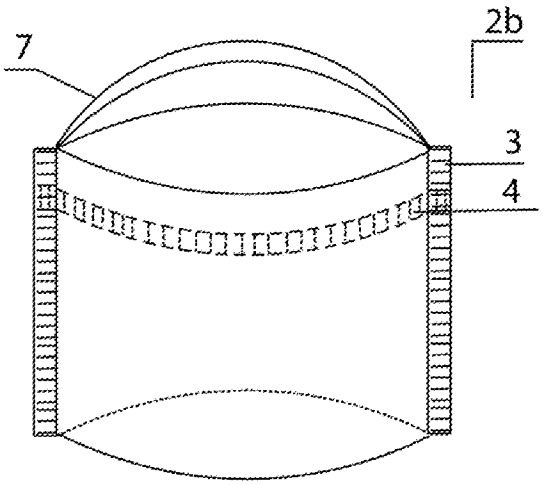
FIG. 4 also illustrates the finished packaging made of the material shown in FIGS. 1 and 3.

In the embodiment (FIG. 2, FIG. 4), the inside of the packaging 2*a*, 2*b* is closed by two lateral joints 3 and one longitudinal joint 4. Between the lateral joints 3, there is a secondary web 6 which constitutes the handle 7 of the packaging. The secondary web 6 is joined with the packaging 2*a*, 2*b* at the points of the lateral joints 3. In this example, the primary material 1*a*, 1 *b* of the packaging 2*a* or 2*b* is a PLA film, and the secondary web 6 is also a PLA film. The handle 7 can be located anywhere along the packaging, e.g. in the middle 2*a* (FIG. 2) or on the side 2*b* (FIG. 4).

The primary material 1*a* or 1 *b* may be paper coated with a PLA film, and the secondary web 6 may be a PLA-coated paper or a PLA film.

Alternate Example

In this example (FIGS. 6 and 7), the webs of the secondary material 8, ultimately constituting the handles 9 made of a PLA polymer film are arranged transversely onto the web of the primary material 1*c*, which is a PLA polymer film. The webs of the secondary material 8 have a length equal to the width of the primary web 1*c* and a width of 10 to 50 mm convenient for the handle. The webs 8 are placed at equal intervals onto the points which, in the final packaging 2*c*, will be the midpoint between the lateral joints 3, and are then joined with the primary material 1*c* in the joint area 10, at least on its edges. Optimally, the joints 10, e.g. seals, cover a larger area of contact of the two materials, but in the area at the front of the final packaging 2*c* the two materials should remain unjoined so as to form the handle 9.

The primary material 1*c* used may be paper coated with a PLA film, and the secondary webs 8 used may be a PLA film or paper coated with a PLA.

Figure 6:
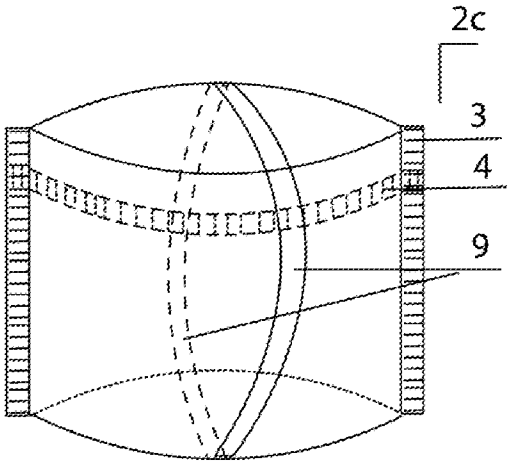
FIG. 6 illustrates the finished packaging made of the material shown in FIG. 7.
Figure 7:
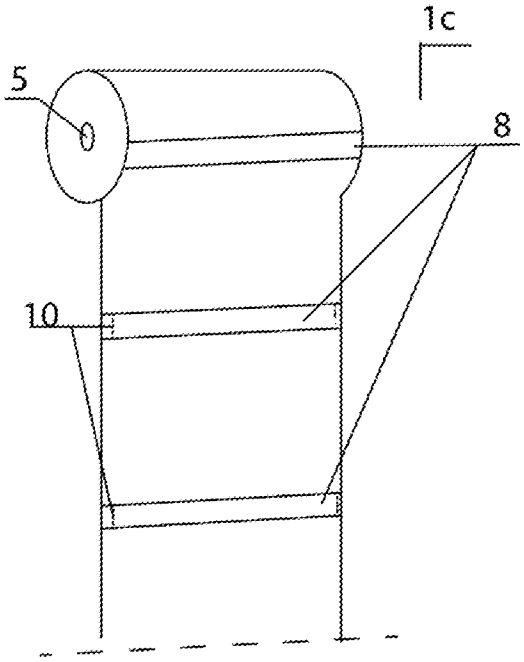
FIG. 7 illustrates a fragment of the material according to the invention comprising a secondary transverse web.

The packaging material (FIG. 7) in the example comprises a web of the primary material 1*c* wound on a roll 5 and it comprises a plurality of secondary webs 8 with a width of 10 to 50 mm, generally smaller than the primary material 1*c*. The secondary webs 8 have a length equal to the width of the primary web 1*c* and they constitute the handles 9 of the final packaging 2*c* (FIG. 6). Both webs are joined one above the other in the joint area 10 at the points which constitute the joint of the handle 9 of the final packaging 2*c* and the primary material 1*c*. This point coincides with the point of longitudinal joints 4 of the final packaging 2*c*. Optimally, the joints, e.g. seals, cover a larger area of contact of the two materials, but in the area at the front of the final packaging 2*c* the two materials are not joined so as to form the handle 10. The material is a PLA polymer film, and the secondary web 8 is also a PLA polymer film. The primary material 1*c* and the secondary webs 8 are sealed together.

The material of the primary web 1*c* may be paper coated with a PLA polymer, while the secondary webs are made of a PLA-coated paper or a PLA film.

In the embodiment (FIG. 6), the inside of the packaging 2*c* is closed by two lateral joints 3 and one longitudinal joint 4. The handle of the packaging 9 in the form of a web surrounds the packaging 2*c* pack and it is joined with the primary material 1*c* at the point of longitudinal joint 4. In this example, the primary material of the packaging 2*c* is a PLA polymer film, a secondary brand 8, so that the handle 9 is also a PLA film. The handle 9 can be located anywhere across the packaging, e.g. in the middle (FIG. 6) or on the side. The primary material of the packaging 2*c* may be paper coated with a PLA polymer film, and the secondary web 8, and, accordingly, the handle 9 may also be a PLA film or paper coated with a PLA polymer.

Example 3

Figure 5:
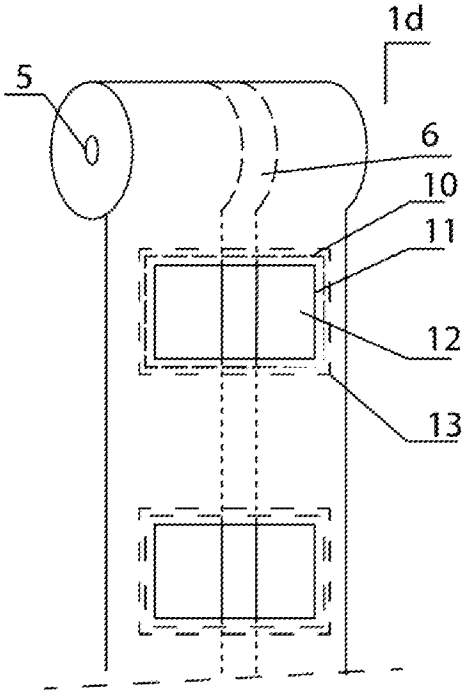
FIG. 5 illustrates a fragment of the material according to the invention comprising a secondary longitudinal web and holes, where the secondary is located in the area of the holes.

In the next example (FIG. 5) first, holes 11 are cut in the primary material 1*d* being a PLA film. The secondary web 6 made of sealable material, e.g. a PLA film, is then placed longitudinally onto the primary material 1*d*, which is placed in the areas of the holes 11, after which fragments of the secondary material 12 are placed onto the primary material 1*d* and the secondary web 6 in the form of a PLA film or a PLA membrane or a cellulose film coated with a PLA polymer with a surface and shape larger than the holes 11 to form an overlap 13. The three materials 1*d*, 6 and 12 are then joined in the joint area 10, in this case by circumferential sealing in the overlap 13 area. Optimally, the heaters are apposed on the side of the primary material 1*d*, but a method is also feasible where the heaters are apposed on the side of the secondary material 12. In the final packaging 2*d*, the handle 7 in the form of a web of material 6 extends through the hole area 11.

The packaging material (FIG. 5) in the example comprises a web of the primary material 1*d* wound on a roll 5 with the holes 11 cut. The web 1*d* comprises one longitudinal secondary web 6 with a width of 10 to 50 mm and generally smaller than the primary material 1*d*. The secondary web 6 is the handle 7 of the final packaging 2*d*. The secondary web 6 is arranged in the areas of holes 11, under the primary material 1*d*. Below it, in the area of holes 11, there are fragments of the secondary material 12 arranged, which are larger than the holes 11 and which form an overlap of 13 when apposed. Materials 1*d*, 6 and 12 are joined in the joint area 10 of the overlaps 13. The materials 1 and 6 may be joined also at the points intended for lateral joints 3 of the final packaging 2*d*. The primary material 1*d* is a PLA polymer film, the secondary web 6 is a PLA polymer film, the secondary material 12 is a PLA polymer film or a PLA polymer membrane or a cellulose film. The materials 1*d*, 6 and 12 are sealed together. The material of the primary web 1*d* may be paper coated with a PLA polymer, while the secondary web 6 may be made of a PLA-coated paper or a PLA film.

Figure 8:
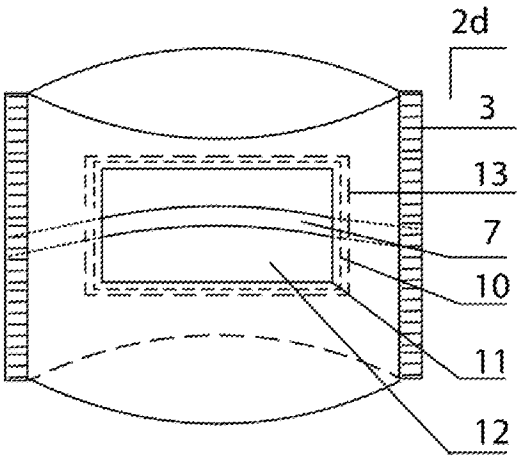
FIG. 8 illustrates a finished packaging made of the material shown in FIG. 5.

The packaging 2*d* (FIG. 8) made of the primary material 1*d*, the inside of which is closed by two lateral 3 and one longitudinal joints (not shown) and a hole 11. Between the lateral joints 3 on the inside of the packaging 4 in the hole area 11 there is a secondary web 6 which constitutes the handle 7 of the packaging. Inside the packaging 2*d*, under the secondary web 6, the hole 11 is closed with the secondary material 12. The material 12 has a surface area greater than the hole 11 and is fixed circumferentially from the inside of the packaging to the primary material 2*d* and to the secondary material 6 in the joint area 10 in the area of the overlaps 13. The secondary web 6 can be joined with the packaging 2*d* also at the lateral joints 3, which further enhances the durability of the packaging 2*d*. In this example, the primary material 1*d* of the packaging 2*d* is a PLA film, and the secondary web 6 is also a PLA film. The hole 11 together with the handle 6 can be located anywhere along the packaging, e.g. in the middle (FIG. 8) or on the side. The secondary material 12 is a PLA polymer film or a PLA polymer membrane or a cellulose film. The materials (1*d*, 6, 12) are joined by seals.

The material of the primary web 1*d* may be paper coated with a PLA polymer, while the secondary webs may be made of a PLA-coated paper or a PLA film.

Example 4

In the next example, the secondary web 6 is not arranged in the area of the holes 11, so that the order of fixing the secondary web 6 and the secondary material 12 is not relevant in the method of manufacture. The secondary web 6 can be located and be locally fixed on the other side of the secondary material 12.

Figure 9:
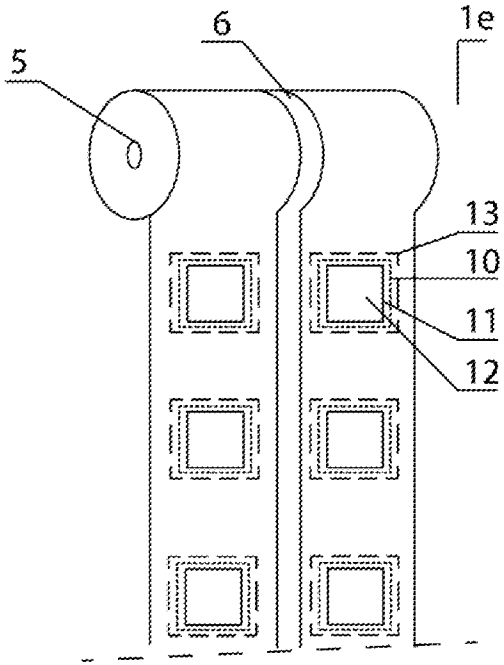
FIG. 9 illustrates a fragment of the material according to the invention comprising a secondary longitudinal web and holes, where the secondary is located in the area of the holes.
Figure 11:
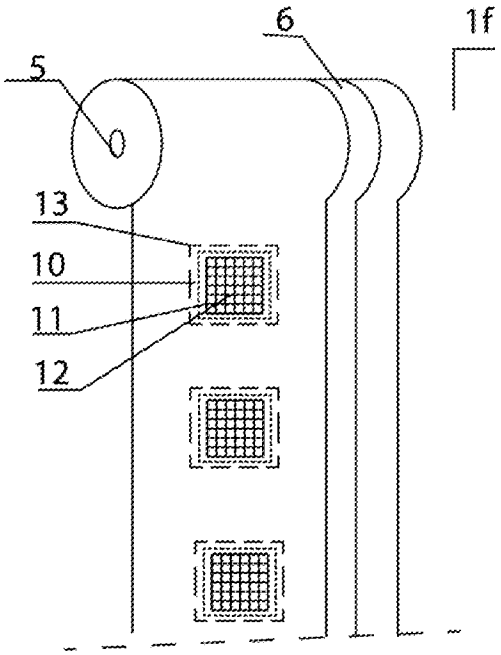
FIG. 11 also illustrates a fragment of the material according to the invention comprising a secondary longitudinal web and holes, where the secondary is located in the area of the holes.

The packaging material (FIGS. 9, 11) in the example comprises a web of the primary material 1*e*, 1*f* wound on a roll 5 and it comprises one secondary web 6 with a width of 10 to 50 mm. The secondary web 6 extends across the primary material. The secondary web 6 is the handle 7 of the finished packaging 2*e* or 2*f*. Both webs are joined one above the other at the points which constitute the joint of the handle 7 of the final packaging 2*e* or 2*f* and the primary material 1*e* or 1*f*. This point coincides with the point of lateral joints 3 of the final packaging 2*e* or 2*f*. The material has holes 11 in which fragments of the secondary material are fixed 12. Fragments of the material 12 have a surface area larger than the surface of individual holes 11 and are fixed to the primary material in the joint area 10 at the overlaps 13. The secondary material 12 is on the other side of the primary material in relation to the secondary web 6. The primary material 1*e* or 1*f* is a PLA polymer film, the secondary material 12 is a PLA polymer film or a PLA polymer membrane or a cellulose film, and the secondary web 6 is also a PLA polymer film. The primary material 1*e* or 1*f* and the secondary web 6 and the secondary material 12 are sealed together. The material of the primary web 1*e* or 1*f* may be paper coated with a PLA polymer, while the secondary web 6 may be made of a PLA-coated paper or a PLA film or a cellulose film.

Figure 10:
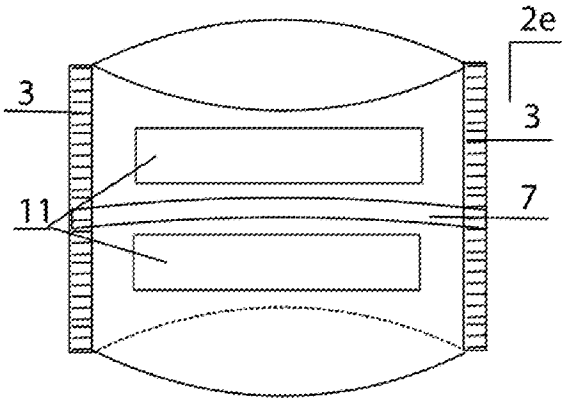
FIG. 10 illustrates finished packaging made of the material shown in FIGS. 9 and 11.
Figure 12:
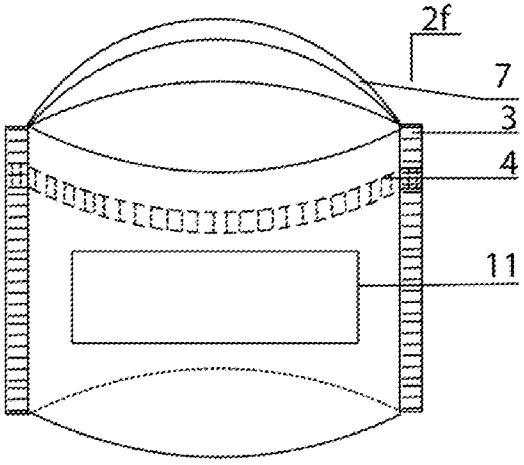
FIG. 12 also illustrates finished packaging made of the material shown in FIGS. 9 and 11.

In the embodiment (FIG. 10, 12), the inside of the packaging 2*e*, 2*f* is closed by two lateral joints 3 and one longitudinal joint 4. Between the lateral joints 3, there is a secondary web 6 which constitutes the handle 7 of the packaging. The secondary web 6 is joined with the packaging at the points of the lateral joints 3. In this example, the primary material 2*e* of the packaging 2*e* and 2*f* is a polymer PLA film, and the secondary web is also a PLA film. The handle 6 can be located anywhere along the packaging, e.g. in the middle of the packaging 2*e* (FIG. 10) or on the side of the 2*f* packaging (FIG. 12).

Preferably, the packaging material of the primary web 1*e* or 1*f* may be paper coated with a PLA polymer, while the handle 7 may be made of a PLA-coated paper or a PLA film or a cellulose film.

Example 5

Figure 13:
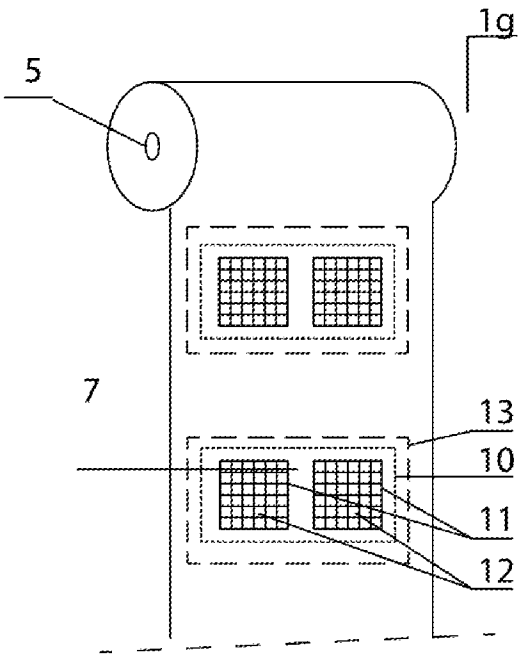
FIG. 13 illustrates a fragment of the material according to the invention, comprising two adjacent holes each, wherein the material between them is the handle in the final packaging.
Figure 15:
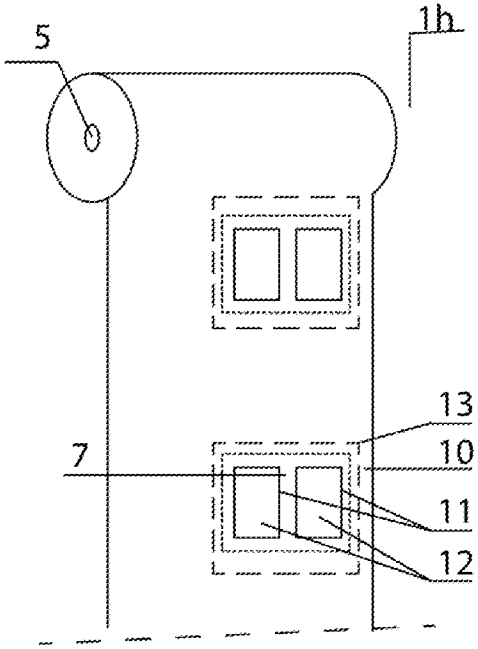
FIG. 15 also illustrates a fragment of the material according to the invention, comprising two adjacent holes each, wherein the material between them is the handle in the final packaging.
Figure 17:
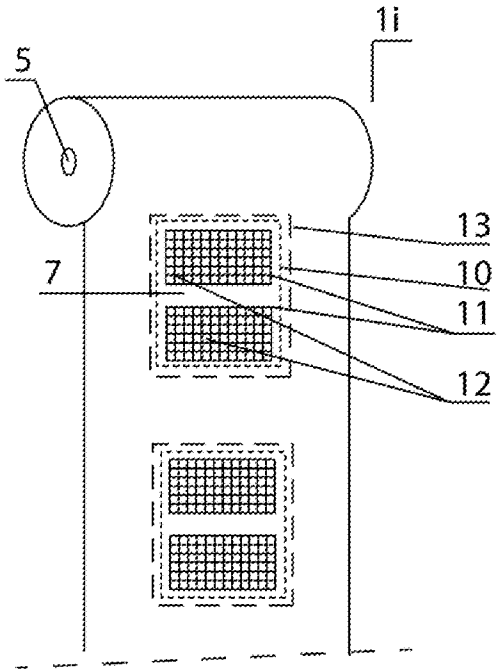
FIG. 17 also illustrates a fragment of the material according to the invention, comprising two adjacent holes each, wherein the material between them is the handle in the final packaging.

The packaging material (FIGS. 13,15,17) consists of at least one primary web 1*g*, 1 *h*, 1*i* wound on the roll 5. The method consists in cutting of at least two adjacent holes 11 in the web 1*g*, 1 *h*, 1*i*, between which there are fragments of the primary material 1*g*, 1*h*, 1*i*. Fragments of the secondary material 12 with a surface and shape greater than the sum of such adjacent holes 11 and the primary material 1*g*, 1 *h*, 1*i* separating them are then apposed onto the area of the holes 11 to form an overlap 13 around them and around the primary material 1 separating them. The materials 1*g*, 1 *h*, 1*i* and 12 are then joined at the joint area 10 in the overlap 13 area only along the inner circumference of the fragment of secondary material 12. The material is then wound on the roll 5. The primary material 1*g*, 1 *h*, 1*i* used is a PLA polymer film, and the secondary material 12 used is a PLA polymer membrane or PLA polymer film or a cellulose film.

The primary material 1*g*, 1 *h*, 1*i* used may be paper coated with a sealable polymer, e.g. PLA.

The packaging material (FIGS. 13,15) consists of at least one primary web 1*g*, 1 *h* wound on the roll 5. Along the primary web 1*g*, 1 *h* there are holes 11 in rows of two cut. Between the two holes 11 hole there is a fragment comprising the primary material 1*g*, 1*h*. The secondary material 12 filling the hole 11 has a surface and shape greater than the sum of the surfaces and shapes of said holes 11 including the surface of the fragment of the primary material 1*g*, 1*h* that joins them. The secondary material 12 covers the holes 11 and the fragment of the primary material 1*g*, 1*h* that joins them to form an overlap 13. The secondary material 12 is fixed to the primary material 1*g*, 1 *h* in the joint area 10 in the overlap 13 area only along its inner circumference. A fragment of the primary material 1*g*, 1 *h* arranged between adjacent holes 11 in the finished packaging forms a handle 7. The handle area 7 is not joined to the secondary material 12 filling the hole 11.

Figure 14:
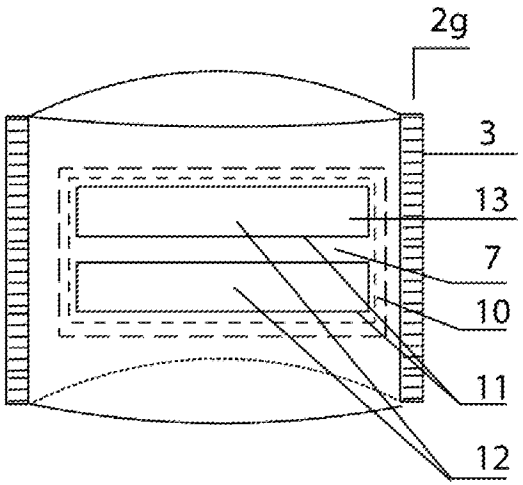
FIG. 14 illustrates a finished packaging made of the material shown in FIG. 13.
Figure 16:
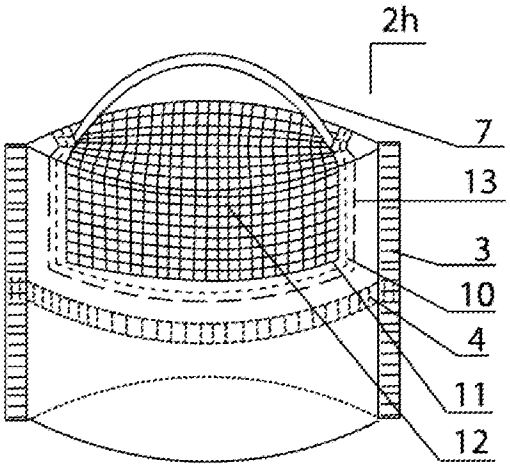
FIG. 16 illustrates a finished packaging made of the material shown in FIG. 15.

The secondary material 12 in the embodiment is a PLA polymer membrane or film or a cellulose film. The primary material 1*g*, 1 *h* is PLA-coated paper. The materials are sealed together. The holes 11 may be cut in the middle of the web of primary material 1*g*, 1*h* (FIG. 13), so that it can be used to manufacture the final packaging 2*g* (FIG. 14) or on the side (FIG. 15), in which case one side of the web of the primary material 1*h* has no holes and the target packaging 2*h* (FIG. 16) can be made from the material.

Figure 18:
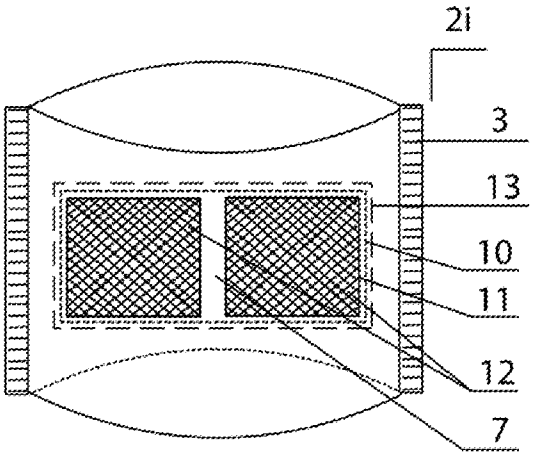
FIG. 18 illustrates a finished packaging made of the material shown in FIG. 17.

The packaging material (FIG. 17) has two holes 11 cut per packaging 2*i* (FIG. 18). The holes are arranged vertically, one above the other. For this design of the packaging material 1*i*, the handle 7 is arranged transversely across the finished packaging 2*i*. Other features of the material are as described above.

The packaging 2*g*, 2*h* (FIGS. 14, 16, 18) made of the primary material 1*g*, 1 *h*, 1*i*, the inside of which is closed by two lateral 3 and one longitudinal 4 joints and a hole 11 filled with the secondary material 12. In the hole 11 between two opposite sides thereof, above the secondary material 12, there is a fragment of the primary material 1*g*, 1 *h*, 1*i*, integrated with a continuous primary web 1*g*, 1 *h*, 1*i*. The fragment of the primary material 1*g*, 1 *h*, 1*i* which constitutes the handle 7 is formed by cutting two adjacent holes 11, which are separated by the fragment of the primary material 1*g*, 1 *h*, 1*i*, so that there is no need for the handle to be additionally joined or glued. In the adjacent holes 11 a secondary material 12 is fixed from the inside of the packaging. A fragment of the material 12 covers adjacent openings separated by the primary material 1*g*, 1*h*, 1*i*. Its surface and shape is larger than the sum of the surface of the openings 11 and of the fragment of primary material 1*g*, 1 *h*, 1*i* separating them, so that an overlap 13 is formed upon placing. A fragment of the secondary material 12 covering the openings is fixed to the primary material along its inner circumference in the joint area 10 in the overlap area 13. The secondary material 12 in the embodiment is a PLA polymer membrane or film or a cellulose film. The primary material is PLA-coated paper. The materials are sealed together. The handle 7 can be located in the area of the hole 11 longitudinally in the middle of the packaging 2*g* (FIG. 14) or on the side of the packaging 2*h* (FIG. 16), or across the packaging 2*i* (FIG. 18).

The primary material may also be a PLA polymer film.

Example 6

Figure 19:
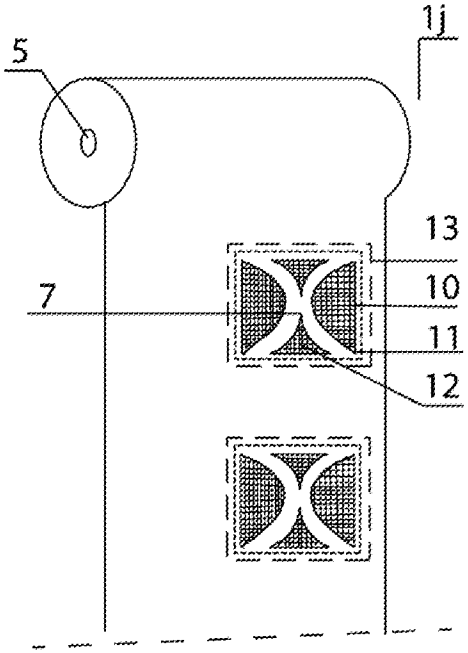
FIG. 19 illustrates a fragment of the material according to the invention, comprising four adjacent holes each, wherein the material between them is the handle in the final packaging.

The packaging material (FIG. 19) consists of at least one primary web 1*j* wound on the roll 5. The method consists in cutting adjacent holes 11 in rows of four in the primary web 1*j* so that the primary material 1*j* is between them. The holes 11 are cut such that the opposite holes 11 are symmetrical to each other. Fragments of the secondary material 12 with a surface and shape greater than the sum of such adjacent holes 11 and the primary material 1*j* separating them are then apposed onto the area of the holes 11 to form an overlap 13 around them and around the material 1*j* separating them. Then materials 1*i* and 12 are joined at the joint area 10 in the overlap 13 area only along the inner circumference of the fragment of secondary material 12. The material is then wound on the roll 5. The primary material 1*j* used is a PLA polymer film, and the secondary material used is a PLA polymer membrane or PLA polymer film or a cellulose film.

The primary material used may be paper coated with a sealable polymer, e.g. PLA.

The packaging material (FIG. 19) consists of at least one primary web 1*j* wound on the roll 5. Adjacent holes 11 are cut along the primary web in rows of four, wherein the opposite holes 11 are symmetrical to each other. Between the four holes 11 hole there is a fragment comprising the primary material 1*j*. The secondary material 12 filling the hole 11 has a surface and shape greater than the sum of the surfaces and shapes of said openings 11 including the surface of the fragments of the primary material 1*j* that join them. The secondary material 12 covers the holes 11 and the fragment of the primary material 1*j* that joins them to form an overlap 13. The secondary material 12 is fixed to the primary material 1*j* in the joint area 10 in the overlap area 13 only along its inner circumference, which is the sum of the adjacent holes 11 and of the fragment of the primary material 1*j* that joins them. Fragments of the primary material 1*j* arranged between adjacent holes in the finished packaging form a handle 7. The handle area 7 is not joined to the secondary material 12 filling the hole 11.

The secondary material 12 in the embodiment is a PLA polymer membrane or film or a cellulose film. The primary material 1*j* is PLA-coated paper. The materials are sealed together around the inner circumference of the secondary material 12. Holes 11 can be cut in the middle or on the side of the web of the primary material 1*j* (FIG. 19), in which case one side of the web of the primary material has no openings and the final packaging 2*j* (FIG. 20) can be made from the material.

Figure 20:
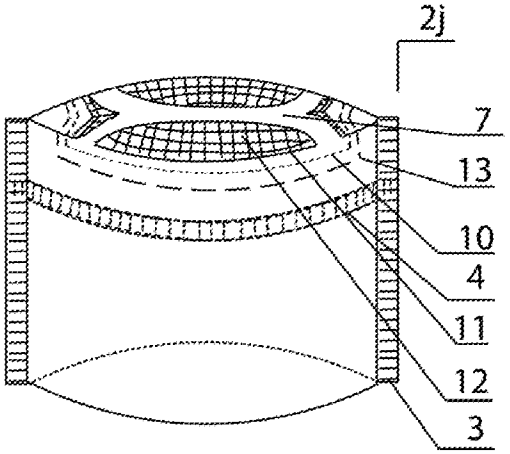
FIG. 20 illustrates a finished packaging made of the material shown in FIG. 19.

The packaging 2*j* (FIG. 20) made of the primary material 1*j*, the inside of which is closed by two lateral 3 and one longitudinal 4 joints and a hole 11 filled with the secondary material 12. In the hole 11 between two opposite sides thereof, above the secondary material 12, there is a fragment of the primary material 1*j*, integrated with a continuous primary web 1*j*. This fragment, which constitutes the handle 7 is formed by cutting four adjacent holes 11, which are separated by the fragment 7 of the primary material 1*j*, so that there is no need for the handle to be additionally joined or glued. In the adjacent holes 11 a secondary material 12 is fixed from the inside of the packaging. A fragment of the material 12 covers adjacent holes separated by the primary material 1*j*. Its surface and shape is larger than the sum of the surface of the holes 11 and of the fragment of primary material 1*j* separating them, so that an overlap 13 is formed upon placing. A fragment of the secondary material 12 covering the holes 11 is fixed to the primary material 1*j* along its inner circumference in the joint area 10 in the overlap area 13. The secondary material 12 in the embodiment is a PLA polymer membrane or film or a cellulose film. The primary material 1*j* is PLA-coated paper. The materials are sealed together around the inner circumference of the secondary material 12. The handle 7 is located in the area of the hole 11 longitudinally on the side of the packaging 2*j* (FIG. 20).

Example 7

Figure 21:
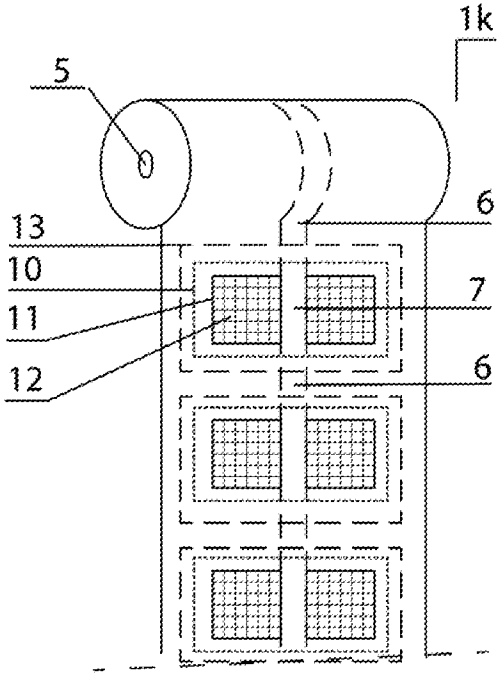
FIG. 21 illustrates a fragment of the material according to the invention, comprising two adjacent holes each, and the secondary web wherein the material between them is the handle in the final packaging, and the secondary web is a reinforcement of said handle.

The packaging material (FIG. 21) consists of at least one primary web 1*k* wound on the roll 5. The method consists in apposing the secondary web 6 with a width smaller than the width of the primary web, such as 10 to 50 mm, onto the primary web 1*k*. The secondary web 6 is ultimately a reinforcement of the handle 7 of the finished packaging. The two webs are then joined. Adjacent holes 11 are then cut in rows or columns of two such that the primary material 1*k* with the secondary web 6 is between them. Fragments of the secondary material 12 with a surface and shape greater than the sum of such adjacent holes 11 and the primary material 1*k* separating them and the secondary web 6 are then apposed onto the area of the holes 11 to form an overlap 13 around them and around the joined materials 1*k* and 6 separating them. Then materials 1*k*, 6 and 12 are joined in the overlap 13 area at the joint area 10 only along the inner circumference of the fragment of secondary material 12. The material is then wound on the roll 5. The primary material 1*k* used is a PLA polymer film, and the secondary material used is a PLA polymer membrane or PLA polymer film or a cellulose film.

The primary material used may be paper coated with a sealable polymer, e.g. PLA.

Figure 22:
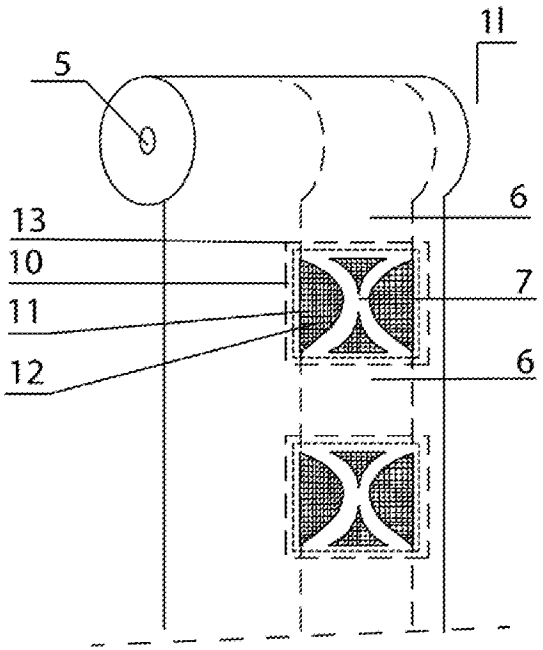
FIG. 22 illustrates a fragment of the material according to the invention, comprising four adjacent holes each, and the secondary longitudinal web, wherein the material between the holes is the handle in the final packaging, and the secondary web is a reinforcement of said handle.

For example, four adjacent holes 11 may also be cut in the primary web 1*l* (FIG. 22). The other steps are as described above.

The packaging material (FIG. 21) consists of at least one primary web 1*k* wound on the roll 5. A secondary web 6 is placed longitudinally onto the primary web 1*k*, which is at least within the fragment of the primary material 1*k* between the openings 11, wherein the secondary web 6 in the final packaging is the reinforcement of the handle 7 formed between the holes. Along the primary web 1*k* there are adjacent holes 11 in rows or columns of two cut. Between the two holes 11 hole there is a fragment comprising the primary material 1*k* and the secondary web 6. The secondary material 12 filling the hole 11 has a surface and shape greater than the sum of the surfaces and shapes of said openings 11 including the surface of the fragments of the primary material 1*k* that join them. The secondary material 12 covers the holes 11 and the fragment of the primary material 1*k* that joins them to form an overlap 13. The secondary material 12 is fixed to the primary material 1*k* and to the secondary web 6 in the overlap 13 area only along its inner circumference in the joint 10 area. The secondary web 6 can extend across the primary material or only in the area of the holes.

The packaging material (FIG. 22) can have four adjacent openings cut out in the primary material 1*l*.

The secondary material in the embodiment is a PLA polymer membrane or film or a cellulose film. The primary material is PLA-coated paper. The secondary web can be a PLA film or a PLA-coated paper. The materials are directly sealed together around the inner circumference of the secondary material 12. The holes 11 may be cut in the middle of the web of primary material 1*k* (FIG. 21), so that it can be used to manufacture a final packaging having the shape of the packaging 2*g* (FIG. 14) or on the side, in which case one side of the web of the primary material has no holes and the final packaging having the shape of the packaging 2*h* (FIG. 16) can be made from the material.

The packaging in this example can have the shape of the packaging 2*e* (FIG. 14) or 2*f* (FIG. 16) or 2*g* (FIG. 18), wherein the handles 7 have reinforcements from the secondary web 6. The design of the packaging is described in the preceding examples 5 and 6.

In the examples above, the primary material 1*a*-1, the secondary material 12 and the secondary web 6 were either a PLA (polylactide) polymer film or paper or cellulose. In each of these examples, the primary material or the secondary web used may well be PE polyethylene or polypropylene (PP) film and/or paper coated with these polymers. The secondary material 12 may also be a cellulose film. It is possible to use various combinations of materials, wherein polymers of the same type are sealable together. Cellulose film is inherently heat sealing and it joins with any thermosetting material. For example, a PE film or a paper coated with PE is sealed to a PE membrane or a PE film. A PP film or a paper coated with PP is sealed to a PP membrane or a PP film.

This limitation does not apply for gluing, so that non-sealable materials, e.g. paper, can also be used.

An example of the secondary material may be a membrane with a weight of 20-30 g/m2. For example, it could be 21.49 g/m2 or 27.84 g/m2. The openings of the membrane are 5.0-7.1 mm×5.0-7.1 mm in size. For example, the membrane can have holes of 5.0 mm×5.0 mm, or, for example, 7.1 mm×7.1 mm. The weave of the membrane is made up of two joined webs of a PLA material. In this case, the webs are permanently joined by sealing to form a thickening at the joint at right angles. The weave of the membrane may also have another type of joint, such as webs of the membrane may be woven together and joined at an angle of 60° and 120°.

For the methods described in the examples above, materials may be joined by a gluing method, e.g. hot gluing. In this case, no heat sealability of the materials is required. Heat sealability, at least of fragments, is in turn required for packaging using VFFS machines. In this case, it is possible to include a further production step consisting in sealing in or gluing in where appropriate for the finished packaging fragments of polymer films, which are then sealed on VFFS machines.

Optimally, the materials are joined directly by sealing. If it is not possible to join the two materials by sealing, it is also possible to use secondary materials between them to allow them to be joined.

The invention is applicable in the manufacture industry of packaging materials, as well as in the food industry and logistics.

In summary, a method for manufacturing a packaging material is described. The method uses a material which includes at least one primary web wound on a roll, and wherein holes are cut in the web onto which fragments of the secondary material are arranged, characterised in that at least two holes are cut in the primary material and the pieces of the secondary material with a surface and shape greater than the sum of such adjacent holes and the primary material separating them are arranged onto the hole area so that an overlap is formed around them and the primary material separating them, after which the materials are joined in the overlap area only along the inner circumference of the piece of the secondary material.

The method as the described can also be characterised in that two holes are cut adjacent and symmetrical to each other in part, at least in relation to a fragment of their circumference.

The method as the described can also be characterised in that 4 holes are cut, with opposite holes being symmetrical to each other.

The method as the described can also be characterised in that onto at least one web of the primary material wound off a roll, at least one secondary web with a width smaller than the width of the primary web, which secondary web ultimately constitutes a reinforcement of the handle of the finished packaging, after which both webs are joined, after which at least two adjacent holes are cut so that the primary material with a secondary web is between them, after which fragments of the secondary material with a surface and shape greater than the sum of such adjacent holes and the primary material separating them are arranged onto the hole area so that an overlap is formed around them and the primary material separating them, after which the materials are joined in the overlap area only along the inner circumference of the piece of the secondary material.

The method as the described can also be characterised in that the primary material, the secondary web and the secondary material used are a film or membrane made of sealable polymer or cellulose film, wherein the polymer is PE, PP or PLA.

The method as the described can also be characterised in that the primary material, the secondary web used are a polymer-coated paper, and the secondary material used is a film or membrane made of sealable polymer or cellulose film, wherein the polymer is PE, PP or PLA.

A packaging material comprising at least one web of the primary material wound on a roll is also described. The material comprises holes with fragments of the secondary material characterised in that between at least two holes there is a fragment comprising the primary material and the secondary material has a surface and shape greater than the sum of the surfaces and shapes of said holes including the surface of the fragment of the primary material that joins them, and it covers the holes and the fragment of the primary material that joins them to form an overlap and it is fixed to the primary material around the inner circumference in the overlap area The material as described above can also be characterised in that the primary material comprises at least one secondary web located within at least the fragment of the primary material between the holes that is attached thereto layerwise, wherein the secondary web in the final packaging constitutes the reinforcement of the handle formed between the holes.

The material as described above can also be characterised in that the primary material and, the secondary web is a polymer-coated paper, and the secondary material is a film or membrane made of sealable polymer or cellulose film, wherein the polymer is PE, PP or PLA.

A packaging made of the primary material is also described. The inside of the packaging is closed by two lateral joints and at least one longitudinal joint and comprises at least one hole filled with the secondary material, characterised in that a fragment of the primary material constituting a handle is placed between at least two holes, wherein from the centre of the packaging, said holes and the fragment of the primary material are covered by the fragment of the primary material, the surface and shape of which are greater than the sum of the surfaces and shapes of the holes and the primary material separating them that forms a circumferential overlap around the openings and is fixed to the primary material in the overlap area around its inner circumference.

The packaging as described above can be characterised in that the fragment of the primary material constituting the handle comprises reinforcements in the form of the secondary web joined thereto layerwise.

The packaging as described above can be characterised in that the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

A method for manufacturing a packaging material is also described. In the method the material is at least one primary web wound on a roll, characterised in that onto at least one web of the primary material wound off a roll, at least one secondary web with a width smaller than the width of the primary web, which secondary web ultimately constitutes a handle of the finished packaging, after which both webs are joined in the joint areas of the handles of finished packaging with the primary material.

The method as described above can be characterised in that the joint area consists of at least two places in the area intended for one final packaging.

The method as described above can be characterised in that holes are cut in the primary material, after which at least one secondary web is placed and fixed to the primary web in the area of the holes, after which fragments of the primary material are placed with an overlap on the areas of the holes and on the fragments of the secondary web with a surface and shape larger than the surface of the individual holes, after which the materials are joined in the area of the overlaps.

The method as described above can be characterised in that the primary material, the secondary web used is a film made of sealable polymer, and the secondary material used is a film or membrane made of sealable polymer or cellulose film, wherein the polymer is PE, PP or PLA.

The method as described above can be characterised in that the primary material, the secondary web used are a polymer-coated paper, and the secondary material used is a film or membrane made of sealable polymer or cellulose film, wherein the polymer is PE, PP or PLA.

A packaging material is also described. The packaging material comprises at least one web of the primary material wound on a roll characterised in that it comprises at least one web of the secondary material of a width smaller than the primary material, constituting the handle of the final packaging, wherein both webs are joined layerwise, locally in a discontinuous manner at least at the points constituting the joint of the handle of the final packaging and of the primary material.

The material as described above can be characterised in that it comprises holes and that the secondary web is arranged in the areas of holes, under the primary material, while under the secondary web there are fragments of the secondary material, which are larger than the holes and which, when placed, form an overlap within which the materials are joined.

The material as described above can be characterised in that the primary material, the secondary web is a film made of a sealable polymer, and the secondary material is a film or membrane made of sealable polymer or cellulose film, wherein the polymer is PE, PP or PLA.

The material as described above can be characterised in that the primary material, the secondary web is a polymer-coated paper, and the secondary material is a film or membrane made of sealable polymer or cellulose film, wherein the polymer is PE, PP or PLA.

A packaging made of a primary material, the inside of which is closed by two lateral and at least one longitudinal joints and comprising a handle, characterised in that between the lateral joints there is a secondary web constituting the handle, wherein the secondary web is joined to the packaging at least at the lateral joints.

The packaging as described above can be characterised in that it comprises at least one hole, closed by a fragment of the secondary material which is larger than the hole and forms an overlap from the middle of the packaging and which is joined with the primary material within the overlap.

The packaging as described above can be characterised in that the secondary web is located in the area of the hole generally above the fragment of the secondary material.

The packaging as described above can be characterised in that the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

A packaging made of the primary material, the inside of which is closed by two lateral and at least one longitudinal joints and comprising a handle, characterised in that the handle of the packaging in the form of a web surrounds the packaging and is joined with the primary material at least at the longitudinal joint.

The packaging as described above can be characterised in that it comprises at least one hole, closed by a fragment of the secondary material which is larger than the hole and forms an overlap from the middle of the packaging and which is joined with the primary material within the overlap.

The packaging as described above can be characterised in that the secondary web is located in the area of the hole generally above the fragment of the secondary material.

The packaging as described above can be characterised in that the primary material is paper coated with a PLA polymer, the secondary web constituting the handle is paper coated with PLA or a PLA film or cellulose film, and the secondary material is a PLA membrane or film or a cellulose film, wherein the lateral and longitudinal joints and the joint of the secondary and primary materials and of the secondary web are in the form of seals.

INDEX OF REFERENCES

1*a-l* primary web
2 *a-j* packaging
3. lateral joints
4. longitudinal joints
5. roll of material
6. secondary web
7. handle
8. transverse secondary web
9. transverse handle
10. joint area
11. hole
12. secondary material
13. overlap It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A packaging material comprising: at least one substrate of a primary material; the primary material substrate having a plurality of at least two adjacent apertures wherein each of the at least two adjacent apertures are covered by a secondary material different from the primary material, said secondary material having a total surface and shape greater than surface and shape of said apertures including a part of the primary material between the apertures, thereby the secondary material covers the apertures and the part of the primary material between the apertures whereby the secondary material forms an overlapping substrate and it is fixed to the primary material around an inner circumference in the overlap area, wherein said secondary material comprises a mesh.

2. The packaging material according to claim 1 wherein said primary material having apertures is wound on a roll.

3. The material according to claim 2 wherein the primary material comprises at least one secondary webbing defined within a part of the primary material between the apertures that is attached thereto layerwise, wherein the secondary webbing in final packaging constitutes a reinforcement of a handle formed between the apertures.

4. A packaging made of a primary material according to claim 1, an interior layer which is closed by two lateral joints and at least one longitudinal joint and comprises at least one aperture filled with the secondary material, comprising a portion of the primary material constituting a handle defined between at least two apertures, wherein from a center point of the packaging, said apertures and the portion of the primary material are covered by a substrate of the secondary material, the surface and shape of which are greater than the surfaces and shapes of the apertures and the primary material separating them that forms a circumferential overlap area around openings and is fixed to the primary material in the overlap area around its inner circumference.

5. The packaging according to claim 4 characterized in that the portion of the primary material constituting the handle comprises reinforcements in form of the secondary webbing joined thereto layerwise.

6. A packaging material according to claim 1 comprising at least one webbing of the primary material wound on a roll wherein the material comprises at least one webbing of the secondary material of a width smaller than the primary material, constituting the handle of the final packaging, wherein both webbings are joined together in a discontinuous manner at least at the points constituting a handle of final packaging and of the primary material.

7. The material according to claim 6 further comprising apertures and that the secondary webbing is arranged in areas of apertures, under the primary material, while under the secondary webbing there is a substrate of the secondary material and the substrate of the secondary webbing overlaps both the apertures, the secondary web, and parts of the primary material.

8. A packaging having a handle made of the material according to claim 1 comprising an interior area wherein the interior area is enclosed by two lateral and at least one longitudinal joints and the packaging further comprising a handle, wherein between the lateral joints there is a secondary webbing constituting the handle, wherein the secondary webbing is joined to the packaging at least at the lateral joints.

9. The packaging according to claim 8 further comprising at least one aperture covered by a layer of the secondary material which is larger than the aperture and extends over a middle of the packaging and which is joined with the primary material on periphery of the layer of the secondary material forming a portion of the secondary material.

10. The packaging according to claim 9 wherein the secondary webbing is located in the area of the aperture above the portion of the secondary material.

11. A packaging made of the primary material according to claim 1 comprising an interior area which is closed by two lateral and at least one longitudinal joints and comprising a handle wherein the handle of the packaging in the form of a webbing surrounds the packaging and is joined with the primary material at least at the longitudinal joint.

12. The packaging according to claim 11 further comprising at least one aperture covered by a substrate of the secondary material which overlaps the aperture and middle of the packaging and wherein the substrate of the secondary material is attached to the primary material around a periphery of the substrate covering the secondary webbing.

* * * * *